US006481821B1

(12) United States Patent
Yun et al.

(10) Patent No.: US 6,481,821 B1
(45) Date of Patent: Nov. 19, 2002

(54) ACTUATOR FOR INK JET PRINTER HEAD USING SHAPE MEMORY ALLOY

(75) Inventors: Sang Kyeong Yun, Suwon (KR); Sung June Park, Suwon (KR); Hae Yong Choi, Kunpo (KR)

(73) Assignee: Samsung Electronics Co., Ltd., Kyungki-Do (KR)

( * ) Notice: Subject to any disclaimer, the term of this patent is extended or adjusted under 35 U.S.C. 154(b) by 0 days.

(21) Appl. No.: 09/442,514

(22) Filed: Nov. 18, 1999

(30) Foreign Application Priority Data

Jul. 13, 1999 (KR) ..... 99-28237

(51) Int. Cl.[7] ..... B41J 2/045
(52) U.S. Cl. ..... 347/20; 347/54
(58) Field of Search ..... 347/68, 71, 72, 347/54, 20, 70

(56) References Cited

U.S. PATENT DOCUMENTS 6,130,689 A * 10/2000 Choi ..... 347/54
6,306,671 B1 * 10/2001 Silverbrook ..... 347/68

FOREIGN PATENT DOCUMENTS

JP 63057251 A * 3/1988 ..... B41J/3/04
JP 02265752 A * 10/1990 ..... B41J/2/045

* cited by examiner

*Primary Examiner*—John Barlow
*Assistant Examiner*—Julian D. Huffman
(74) *Attorney, Agent, or Firm*—Darby & Darby

(57) ABSTRACT

The present invention relates to an actuator for an ink jet printer head using a shape memory alloy which includes a lower space part; a silicon substrate where said lower space part is formed; an insulating film formed on said silicon substrate surface and made of a silicon oxide film which acts to push the shape memory alloy film to nozzle side direction and a silicon nitride film which acts to pull the shape memory alloy film in a direction opposite to nozzle side; and a shape memory alloy layer formed upon said insulation film so as to cover said lower space part. The invention can make effect to prevent print state deterioration by repetitive use as it can minimize actuator fatigue phenomenon by repetitive use by way of initial transformation direction and magniture control according to insulation film formation of adequate composition and thickness.

3 Claims, 3 Drawing Sheets

ACTUATOR FOR INK JET PRINTER HEAD USING SHAPE MEMORY ALLOY

BACKGROUND OF THE INVENTION

1. Field of the Invention

The present invention relates to an actuator for an ink jet printer head. In particular, the invention relates an actuator for an ink jet printer head using a shape memory alloy and an insulating film.

2. Description of the Prior Art

FIGS. 1*a* through 1*f* show a conventional manufacturing method of actuator for ink jet printer head using a shape memory alloy.

Photoresist 12 is coated on silicon substrate 10 to form a pattern after which it is etched. Part removed by etching is covered with polysilicon 14 and a shape memory alloy layer 16 is formed in wished pattern upon silicon substrate 10.

Polysilicon 14 is removed by etching after the shape memory alloy layer 16 formation; and the shape memory alloy layer 16 becomes a cantilever structure by bending deformation as in FIG. 1*f* after polysilicon 14 removal.

FIGS. 2*a* through 2*d* show the usual manufacturing method of an actuator for ink jet printer head using a shape memory alloy.

Silicon substrate 20 is used for a substrate plate in the actuator for an ink jet printer head using a shape memory alloy.

Insulating film 22 is formed upon silicon substrate 20 upon which film then the shape memory alloy layer 24 is formed.

After shape memory alloy layer 24 has been formed, lower space part is formed by etching the silicon substrate 20 below. Whence insulating film 22 plays the etching interruption layer role.

Bending deformation takes place at insulation film 22 by stress after etching. Then bending deformation takes place also at shape memory alloy layer 24 according to the above bending deformation of insulation film 22.

Actuator for ink jet printer head using a shape memory alloy manufactured by method described above generally consists of silicon substrate 20 where lower space is formed, insulation film 22 formed to cover lower space part upon silicon substrate 20, and shape memory alloy layer 24 formed upon the insulation film 22.

FIG. 3 shows actuator for ink jet printer head using a shape memory alloy, manufactured by method as shown in FIGS. 2*a* through 2*d*; and FIG. 4 shows the jet unit part of ink jet printer head applying the actuator.

As shown in FIG. 4, chamber 26 and nozzle 28 are formed upon actuator using a shape memory alloy as in FIG. 3.

If actuator is electrified, shape memory alloy layer 24 of actuator recovers flat state which is mother shape, according to which shape transformation the volume of chamber 26 formed upon shape memory alloy layer 24 is decreased, whereby ink in chamber 26 is jetted through nozzle 28 to execute printing.

In traditional actuator for ink jet printer head using a shape memory alloy as above, initial transformation of shape memory alloy layer is controlled using compressive stress of silicon oxide film as only silicon oxide film is used for insulation film.

There it is difficult to control compressive stress deformation direction and size and also there is problem that fatigue phenomenon arises by repetitive use.

SUMMARY OF THE INVENTION

Purpose of the present invention to solve the above problem is to provide actuator for ink jet printer head using a shape memory alloy, optimized of ink ejection characteristics by shape memory effect of shape memory alloy, by controlling the internal stress by way of material and thickness of insulation film which transforms in multilayer construction with shape memory alloy.

The invention to achieve the above purpose features an actuator for ink jet printer head using a shape memory alloy, the actuator comprising: a lower space part; a silicon substrate where the lower space part is formed; an insulating film formed on the silicon substrate surface and made of silicon nitride film which acts to pull the shape memory alloy film in a direction opposite to nozzle side; and a shape memory alloy layer formed on the insulation film so as to cover the lower space part, whereby initial transformation direction and magnitude are controlled.

And the invention features an actuator for ink jet printer head using a shape memory alloy, the actuator comprising: a lower space part; a silicon substrate where the lower space part is formed; an insulating film formed on the silicon substrate surface and made of a silicon oxide film which acts to push the shape memory alloy film to nozzle side direction and a silicon nitride film which acts to pull the shape memory alloy film in a direction opposite to nozzle side; and a shape memory alloy layer formed on the insulation film so as to cover the lower space part, whereby initial transformation direction and magnitude are controlled.

DETAILED DESCRIPTION

Figure 1:
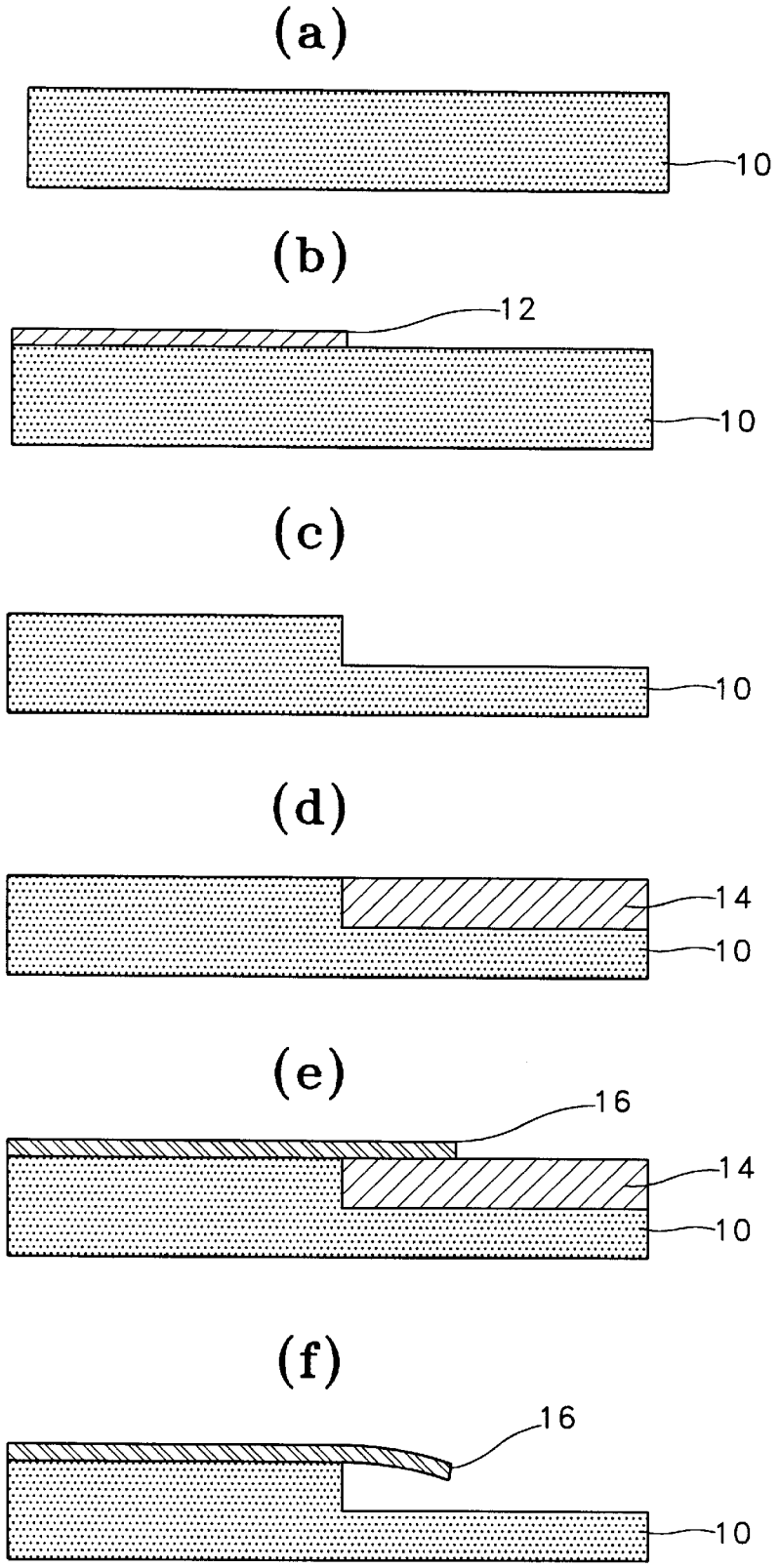
FIG. 1*a* through if are process diagram showing manufacturing method of actuator for ink jet printer head using a shape memory alloy.
Figure 2:
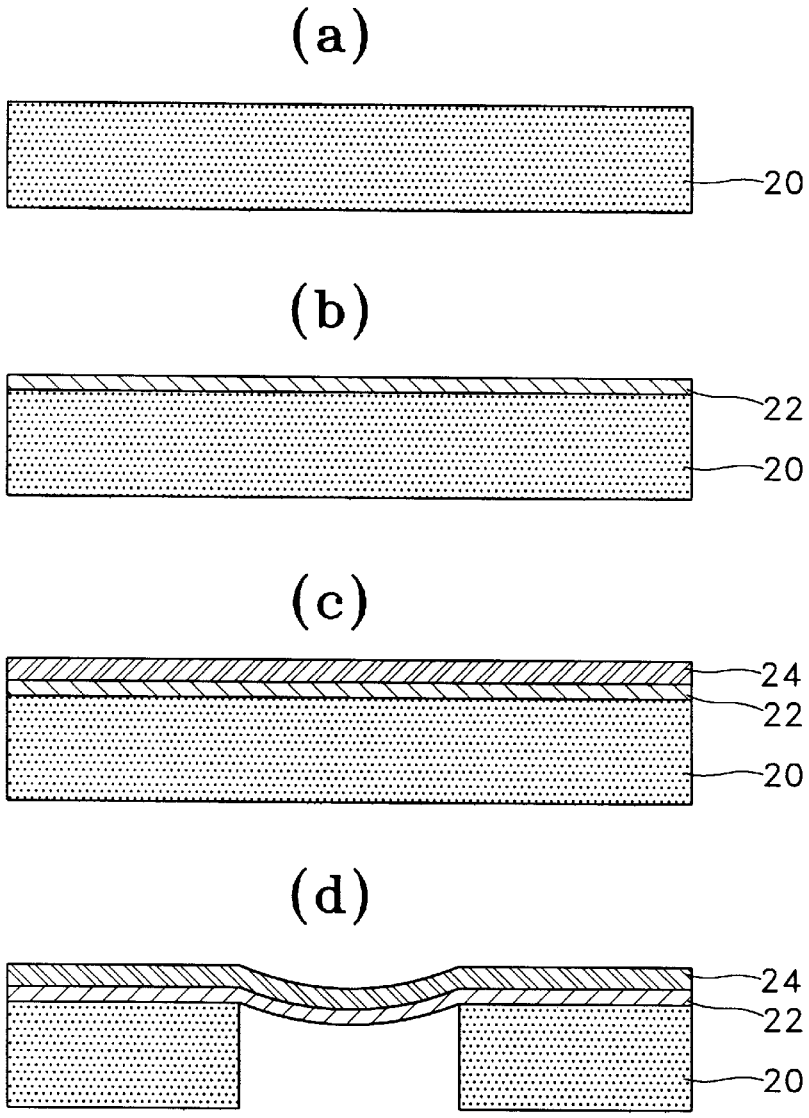
FIGS. 2*a* through 2*d* are process diagram showing general manufacturing method of actuator for ink jet printer head using a shape memory alloy.
Figure 3:
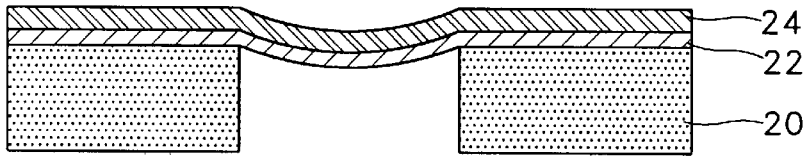
FIG. 3 is cross section view of actuator for ink jet printer head using a shape memory alloy formed by method of FIGS. 2*a* through 2*d*.
Figure 4:
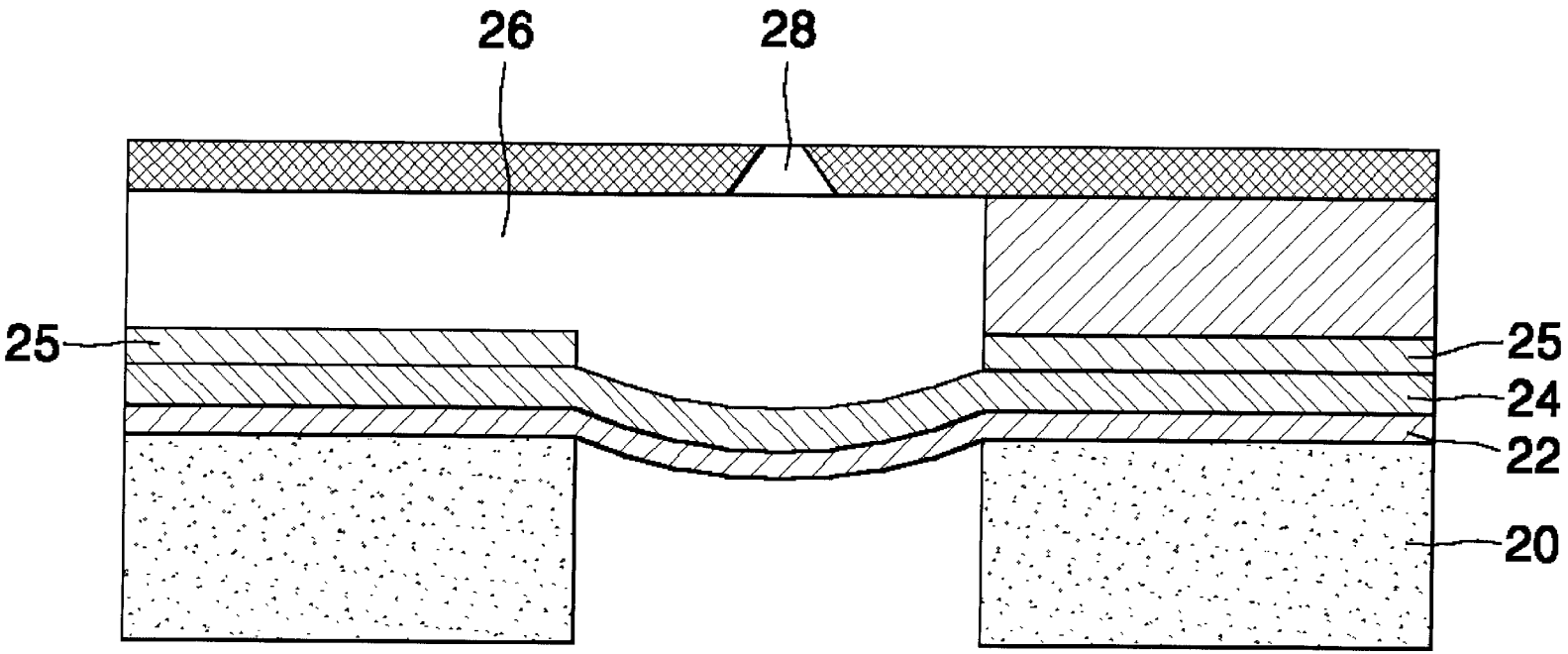
FIG. 4 is cross section view of ink jet unit part of ink jet printer head applying the actuator of FIG. 3 for ink jet printer head using a shape memory alloy.

The invention is explained in detail as follows.

As for substrate, silicon substrate is used.

Insulating film of silicon nitride film or silicon oxide film/nitride film is formed on silicon substrate surface.

The silicon nitride film or silicon oxide film/nitride film is formed by methods of heat treatment, chemical vapor deposition, sputtering etc.

The insulating film formed on silicon substrate surface functions for the shape memory alloy layer to experience a bending deformation by stress when silicon substrate has been etched.

Insulation film of adequate composition and thickness shall be formed according to needed internal stress magnitude because the oxidized silicon film acts to push the shape memory alloy film to direction of nozzle while the nitrified silicon film acts to pull the shape memory alloy film to the opposite side. Whence the internal stress is controlled by varying the insulating film growth condition.

So initial transformation direction and magnitude of the shape memory alloy layer may be controlled by controlling the internal stress by the insulating film component and composition control.

It is preferable to form the insulation film 0.5–3 μm thick.

The shape memory alloy layer is formed by sputtering or vacuum evaporation deposition of shape memory alloy layer composition elements upon insulation film formed. It is preferable to form the shape memory alloy layer 1–3 μm thick and more preferably 2 μm thick.

It is preferable to use 2- or 3-component system for shape memory alloy layer components.

It is preferable to use nickel and titanium for shape memory alloy components if the alloy layer is to be formed of 2-component system.

It is preferable to use nickel, titanium and copper or nickel, titanium and hafnium for shape memory alloy components if the alloy layer is to be formed of 3-component system.

By repetition of thermally treating and cooling process of the shape memory alloy layer formed, composition elements and thermal elastic transformation characteristics are controlled to donate shape memory property to the shape memory alloy layer.

Bestowed shape memory property depends on heat treatment temperature, heat treatment duration, heat treatment method, cooling time and process repetition degree.

Shape memory alloy bestowed of shape memory property may be patterned to a specified pattern as needed.

To pattern the shape memory alloy, use is made of method to pattern it by etching after masking using a shadow mask or a photoresist.

The insulating film formed below shape memory alloy may be patterned as needed after patterning the shape memory alloy into wanted pattern, where method to pattern the insulating film may use same method as how to pattern the shape memory alloy.

Electrode 25 is formed into wanted pattern if needed on substrate where shape memory alloy and insulation film have been formed. Whence electrode is generally made of selected material from aluminum, gold, platinum and silver.

After the above processes finished, lower space part is formed by etching whole silicon substrate after pattern is formed on silicon substrate.

Dry etching and wet etching may be used alike while it is preferable to use dry etching method if to miniaturize whole structure of ink jet printer head applying a microactuator using a shape memory alloy.

Whence insulation film formed on silicon substrate surface takes function of etching discontinuity layer.

If space is formed at lower part by etching the silicon substrate where shape memory alloy is formed, insulation film bends by internal stress of silicon substrate whereby shape memory alloy layer also goes bending transformation in which state it remains as deformed.

Microactuator manufactured as described above for ink jet printer head comprising a lower space part; a silicon substrate where the above lower space part is formed; an insulating film formed on the above silicon substrate surface; and a shape memory alloy layer formed upon the above insulation film so as to cover the above lower space part; where the above insulating film is not formed of silicon oxide film but of silicon nitride film or silicon oxide film/silicon nitride film.

Actuator of the present invention as above is different in internal stress i.e. force formed at silicon nitride film or silicon oxide film/nitride film making up the insulating film from that at silicon oxide film and varies depending on compositions of silicon oxide film and nitride film in silicon oxide film/nitride film so that it is different from conventional actuators using silicon oxide film for insulating film in the initial bending transformation degree.

So bending deformation degree of shape memory alloy layer which goes bending deformation according to bending deformation degree of insulation film also is variant and shape memory alloy layer and insulation film deformation degrees are variant when an identical voltage is applied.

The present invention as described above can prevent print state deterioration by repetitive use as it can minimize actuator fatigue phenomenon by repetitive use by way of initial transformation direction and magnitude control according to insulation film formation of adequate composition and thickness so that system reliability is improved as it can maintain uniform print state.

What is claimed is:

1. An actuator for an ink jet printer head using a shape memory alloy film, said actuator comprising:

a lower space part;

a silicon substrate where said lower space part is formed;

an insulating film formed on said silicon substrate surface and made of a silicon oxide film which acts to push the shape memory alloy film to nozzle side direction and a silicon nitride film which acts to pull the shape memory alloy film in a direction opposite to nozzle side;

and a shape memory alloy layer formed on said insulation film so as to cover said lower space part, whereby initial transformation direction and magnitude of the shape memory alloy layer are controlled by the insulating film.

2. The actuator in claim 1, further comprising an electrode formed on said shape memory alloy layer.

3. The actuator in claim 1, wherein said insulation film is 0.5–3 μm thick.

* * * * *

UNITED STATES PATENT AND TRADEMARK OFFICE

CERTIFICATE OF CORRECTION

PATENT NO. : 6,481,821 B1
DATED : November 19, 2002
INVENTOR(S) : Sang Kyeong Yun et al.

It is certified that error appears in the above-identified patent and that said Letters Patent is hereby corrected as shown below:

Title page,
Item [56], U.S. PATENT DOCUMENTS, insert
-- 6,343,849 02/2002 Yun, et al. --

Signed and Sealed this

Sixth Day of May, 2003

JAMES E. ROGAN
*Director of the United States Patent and Trademark Office*